US009506383B2

(12) United States Patent
Hattori et al.

(10) Patent No.: US 9,506,383 B2
(45) **Date of Patent: *Nov. 29, 2016**

(54) BLOW-BY GAS REFLUXING DEVICE

(71) Applicant: Aisan Kogyo Kabushiki Kaisha, Obu-shi, Aichi-ken (JP)

(72) Inventors: Makoto Hattori, Aisai (JP); Hirokazu Konohara, Inazawa (JP); Minoru Onobayashi, Tokai (JP)

(73) Assignee: AISAN KOGYO KABUSHIKI KAISHA, Obu-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/323,605

(22) Filed: Jul. 3, 2014

(65) Prior Publication Data

US 2014/0311468 A1 Oct. 23, 2014

Related U.S. Application Data

(62) Division of application No. 12/845,841, filed on Jul. 29, 2010, now Pat. No. 8,813,731.

(30) Foreign Application Priority Data

Sep. 30, 2009 (JP) ..... 2009-227381
Oct. 30, 2009 (JP) ..... 2009-250541

(51) Int. Cl.
*F02B 25/00* (2006.01)
*F01M 13/02* (2006.01)

(52) U.S. Cl.
CPC ..... *F01M 13/021* (2013.01); *F01M 13/022* (2013.01); *F01M 13/028* (2013.01); *F01M 2013/026* (2013.01)

(58) Field of Classification Search
CPC .... F01M 13/022; F01M 25/06; F01M 13/04; F01M 13/028; F01M 2013/027; F01M 2013/0038; F01M 2013/0055
USPC ..... 123/572–574, 41.86
See application file for complete search history.

(56) References Cited

U.S. PATENT DOCUMENTS 5,499,604 A * 3/1996 Ito et al. ..... 123/41.86
7,699,029 B2 * 4/2010 Herman et al. ..... 123/41.86

(Continued)

FOREIGN PATENT DOCUMENTS

CN 101432505 A 5/2009
JP S5699046 U 8/1981
JP S62117212 U 7/1987

OTHER PUBLICATIONS

Chinese Office Action issued May 6, 2014, corresponding to Chinese Patent Application No. 201210357052.5.

(Continued)

*Primary Examiner* — Marguerite McMahon
(74) *Attorney, Agent, or Firm* — Ladas & Parry LLP

(57) ABSTRACT

A blow-by gas refluxing device is provided for an engine system including an engine and an intake air passage communicating with the engine for supplying intake air into the engine. The blow-by gas refluxing device includes a plurality of blow-by gas refluxing passages each having an inlet communicating with the engine and an outlet communicating with the intake air passage. The outlets of the blow-by gas passages communicate with the intake air passage at different positions along the length of the intake air passage and each of the blow-by gas passages has a backflow preventing device disposed therein, so that blow-by gas produced in the engine can flow into the intake air passage via at least one of the blow-by gas refluxing passages throughout the entire operational range of the engine.

20 Claims, 8 Drawing Sheets

(56) References Cited

U.S. PATENT DOCUMENTS

| | | | |
|---|---|---|---|
| 2008/0083399 | A1 | 4/2008 | Hirano et al. |
| 2009/0320809 | A1 | 12/2009 | Ruppel et al. |

OTHER PUBLICATIONS

Chinese Office Action issued Feb. 4, 2015, corresponding to Chinese Patent Application No. 201210357052.5.

* cited by examiner

BLOW-BY GAS REFLUXING DEVICE

This application is a divisional of U.S. application Ser. No. 12/845,841, Jul. 29, 2010, which claims benefit to the priority of Japanese patent application serial numbers 2009-227381 and 2009-250541, the contents of all of which are incorporated herein by reference.

BACKGROUND OF THE INVENTION

1. Field of the Invention

The present invention relates to a blow-by gas refluxing device provided in an engine system having an engine, an intake air passage and a supercharger disposed in the intake air passage. The blow-by gas refluxing device refluxes blow-by gas, which is generated in the engine, to the engine through the intake air passage.

2. Description of the Related Art

It has been known that in an engine installed on an automobile or the like, blow-by gas may be leaked from a combustion chamber to a crankcase through a gap between a piston and a cylinder and may deteriorate engine oil contained in the engine.

A technique relating to a blow-by gas refluxing device that ventilates blow-by gas leaked into a crankcase is reported in Japanese Laid-Open Utility Model Publication No. 4-8711.

The above publication discloses a technique of providing a blow-by gas refluxing device, which has a blow-by gas passage for introducing the blow-by gas from the crankcase to an engine intake air system, a main turbocharger and a sub turbocharger provided in parallel with respect to an engine, intake air and exhaust gas changeover valves that switch between an actuating state and a de-actuating state of the sub turbocharger, and an intake air bypass passage that connects between the downstream side of the sub turbo-charger and the upstream side of the main turbocharger. A discharge outlet on the negative-pressure side of the blow-by passage is connected with the intake air passage on the downstream side of the throttle valve, and the discharge outlet on the atmosphere side of the blow-by gas passage is connected with the intake air bypass passage, thereby introducing the blow-by gas from the crankcase to the intake air system.

However, according to the technique of the above publication, when the pressure on the downstream side of the throttle valve becomes higher than the internal pressure of the crankcase, a problem may be caused that the inside of the crankcase cannot be sufficiently ventilated due to air flow into the blow-by gas passage via the discharge outlet on the negative-pressure side of the blow-by gas passage.

Therefore, there is a need in the art for a blow-by gas refluxing device that can reflux blow-by gas produced in an engine throughout the entire operational range of the engine.

SUMMARY OF THE INVENTION

A blow-by gas refluxing device is provided for an engine system including an engine and an intake air passage communicating with the engine for supplying intake air into the engine. The blow-by gas refluxing device includes a plurality of blow-by gas refluxing passages each having an inlet communicating with the engine and an outlet communicating with the intake air passage. The outlets of the blow-by gas passages communicate with the intake air passage at different positions along the length of the intake air passage and each of the blow-by gas passages has a backflow preventing device disposed therein, so that blow-by gas produced in the engine can flow into the intake air passage via at least one of the blow-by gas refluxing passages throughout the entire operational range of the engine.

BRIEF DESCRIPTION OF THE DRAWINGS

FIG. 3(*b*) is a sectional view showing an opening state of the check valve;

DETAILED DESCRIPTION OF THE INVENTION

Figure 1:
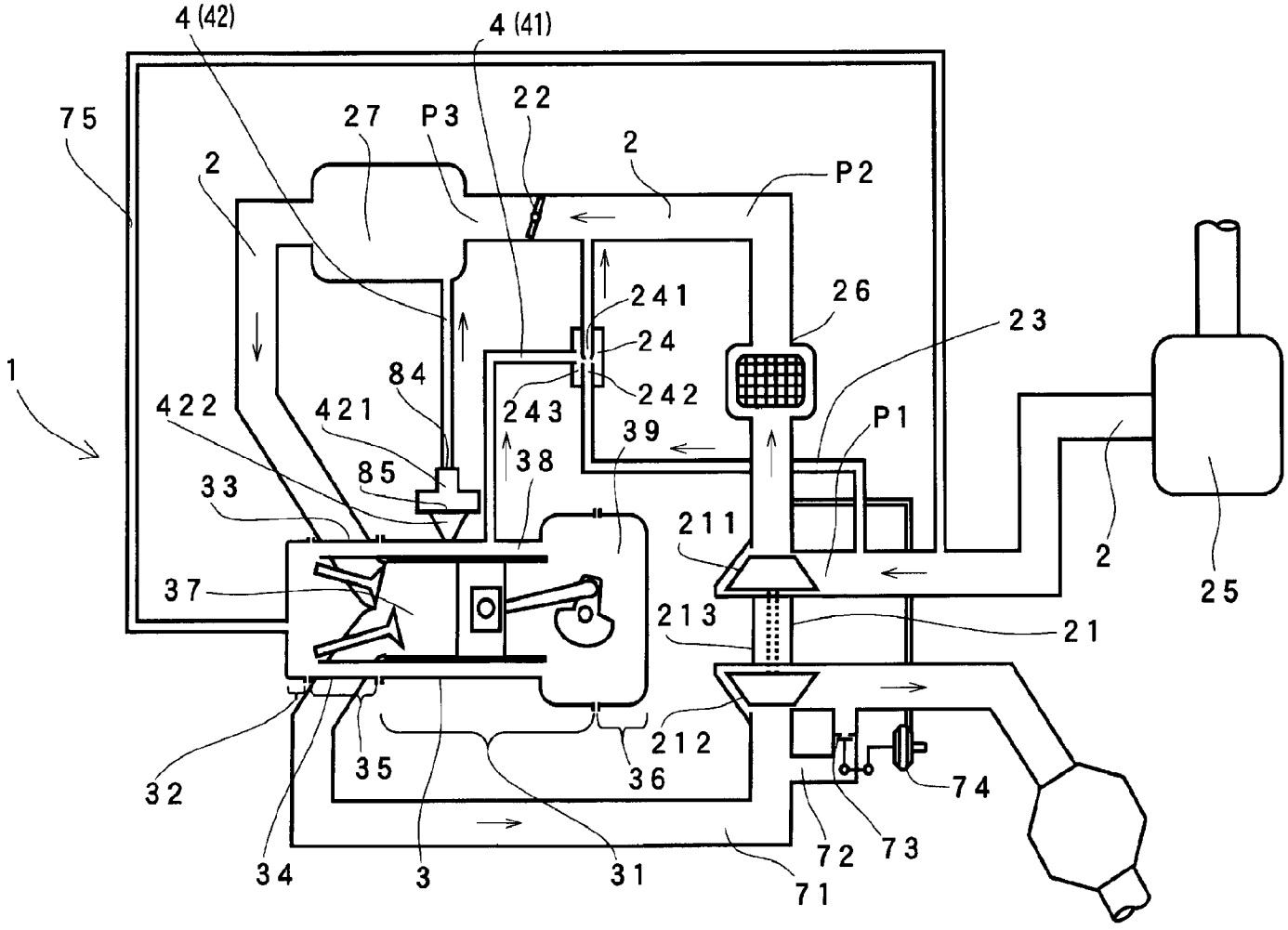
FIG. 1 is an explanatory view of an engine system incorporating a blow-by gas refluxing device according to a first example.

Each of the additional features and teachings disclosed above and below may be utilized separately or in conjunction with other features and teachings to provide improved blow-by gas refluxing device and engine systems incorporating the blow-by gas refluxing devices. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings.

In one example, a blow-by gas refluxing device is provided for an engine system including an engine, an intake air passage, and a supercharger and a throttle valve each disposed in the intake air passage. The throttle valve is disposed on a downstream side of the supercharger in the intake air passage. The blow-by gas refluxing device includes a blow-by gas refluxing passage configured to allow blow-by gas produced in the engine to flow into the intake air passage and to be refluxed into the engine, and an intake air bypass passage connecting between an upstream side and a downstream side of the supercharger in the intake air passage. The blow-by gas refluxing passage includes a first blow-by gas refluxing passage and a second blow-by gas refluxing passage. The first blow-by gas refluxing passage has an inlet and an outlet. The inlet is connected to at least one of a cylinder block and a cylinder head cover of the engine. The outlet is connected to the intake air bypass passage. The at least one of the first blow-by gas refluxing passage and the intake air bypass passage has a first backflow prevention device disposed therein for preventing the blow-by gas from flowing from the first blow-by gas refluxing passage into the at least one of the cylinder block and the cylinder head cover. The second blow-by gas refluxing passage has an outlet connected to the intake air passage on the downstream side of the throttle valve and has a second backflow prevention device disposed therein for preventing the blow-by gas from flowing from the second blow-by gas refluxing passage into the at least one of the cylinder block and the cylinder head cover.

Because the blow-by gas refluxing device has the above mentioned constitution, inside of at least one of the crankcase and the head cover can be well ventilated throughout the entire operating range of the engine.

With the above blow-by gas refluxing device, a pressure on the upstream side of the supercharger in the intake passage (hereinafter called "pressure P1") becomes to be an atmospheric pressure throughout the entire operating range of the engine.

During the idling operation, the rotational speed of the compressor is low, and therefore, a pressure within a path from the downstream side of the supercharger to the throttle valve in the intake passage (hereinafter called "pressure P2") becomes to be an atmospheric pressure, while a pressure on the downstream side of the throttle valve in the intake air passage (hereinafter called "pressure P3") becomes to be a negative pressure. Therefore, a relationship "P1=P2>P3" is resulted during the idling operation.

When the degree of opening of the throttle valve is small, the rotational speed of the compressor increases, the pressure P2 increases and becomes to be a positive pressure but the pressure P3 is kept to be a negative pressure. Therefore, when the throttle opening degree is small, a relationship "P2>P1>P3" is resulted.

When the degree of opening of the throttle is large, the rotational speed of the compressor increases, so that the pressure P2 increases, while the pressure P3 becomes positive so as to be greater than the pressure P1 and to be substantially equal to the pressure P2. Therefore, when the throttle opening is large, the relationship "P2 □P3>P1" is resulted.

With the blow-by gas refluxing device, during the idling operation (where "P1=P2>P3"), the negative pressure (i.e., the pressure P3) generated in the intake air passage one the downstream side of throttle valve is applied to the second blow-by gas refluxing passage. Therefore, the blow-by gas leaked from the combustion chamber of the engine to the inside of the crankcase or the cylinder head cover flows into the intake air passage through the second blow-by gas refluxing passage. As a result, during the idling operation, blow-by gas is refluxed to the engine through the second blow-by gas refluxing passage.

During the idling operation, there is no substantial pressure difference between the pressures P1 and P2, and therefore, no flow of air occurs in intake air bypass passage, and the refluxing of the blow-by gas does not occur through the first blow-by gas refluxing passage.

When the throttle opening degree is small (where the relationship "P2>P1>P3" is resulted), similar to the idling operation, the negative pressure (i.e., the pressure P3) generated in the intake air passage on the downstream side of the throttle valve is applied to the second blow-by gas refluxing passage, so that blow-by gas leaked from the combustion chamber of the engine flows into the intake air passage through the second blow-by gas refluxing passage.

In addition, when the throttle opening degree is small, a pressure difference (due to P2>P1) occurs between the upstream side and the downstream side of the supercharger in the intake air passage, and therefore, a pressure difference also occurs between opposite ends of the intake air bypass passage. Air may flow in the intake air bypass passage by this pressure difference. By this flow of air, blow-by gas generated in the engine flows into the intake air passage through the first blow-by gas refluxing passage and the intake air bypass passage. Then, the blow-by gas introduced into the intake air passage is refluxed into the combustion chamber of the engine through the supercharger and the intake air passage. Thus, when the throttle opening degree is small, the blow-by gas is refluxed to the engine through both of the first blow-by gas refluxing passage and the second blow-by gas refluxing passage.

Further as the supercharging pressure of the supercharge increases, the pressure difference between the upstream side and the downstream side of the supercharger becomes large, and therefore, the flow rate of blow-by gas flowing from the engine into the first blow-by gas refluxing passage increases and the flow rate of blow-by gas flowing into the intake air passage increases.

Furthermore, the intake air bypass passage is arranged to bypass a part of the intake air passage, and therefore, the intake air bypass passage does not affect the resistance against flow of air through the intake air passage. Consequently, during the supercharger is operating, the blow-by gas can be refluxed to the combustion chamber without increasing the resistance against flow of intake air within the intake air passage, and the flow rate of the refluxing blow-by gas can be increased according to the increase of the supercharging pressure.

At that time, the pressure in the intake air bypass passage may become larger than the pressure in the crankcase and the head cover. However, potential backflow toward the engine side can be prevented by the first backflow prevention device provided in the first blow-by gas refluxing passage or the intake air bypass passage.

When the throttle opening degree is large (where the relationship "P2 □P3>P1" is resulted), in the same manner as the case when the throttle opening degree is small, the pressure difference (due to P2>P1) occurs in the intake air between the upstream side and the downstream side of the supercharger in the intake air passage, and therefore, a pressure difference occurs between opposite ends of the intake air passage. Air may flow into the intake air bypass passage due to this pressure difference, and by this flow of air, blow-by gas generated in the engine flows into the intake air passage through the first blow-by gas refluxing passage and the intake air bypass passage.

Namely, when the degree of opening of the throttle valve is large, the blow-by gas can be refluxed to the engine through the first blow-by gas refluxing passage.

When the throttle opening degree is large, the pressure P3 becomes to be a positive pressure. However, potential backflow toward the engine side can be prevented by the second backflow prevention device arranged in the second blow-by gas refluxing passage. Therefore, the ventilating ability may not be lowered by the backflow.

In this way, in any of the engine conditions including the conditions during the idling operation and when the throttle opening degree is small and large, the blow-by gas can be refluxed into the engine. Namely, even in the case that the pressure at the outlet on the side of the intake air passage side in the intake air passage is higher than the internal pressure of the crankcase or the cylinder head cover, backflow from the side of the intake air passage to the side of the engine is prevented, and therefore, throughout the entire operating condition of the engine, the blow-by gas refluxing device can perform effective ventilation from inside the crankcase and the cylinder head cover formed by the cylinder block and the oil pan.

Further, because it is possible to perform effective ventilation, the oil maintenance interval can be extended.

As noted above, the blow-by gas refluxing device is provided for an engine system including an engine, an intake air passage, a supercharger and a throttle valve arranged on the downstream side of the supercharger in the intake air passage.

For example, an engine, to which the blow-by gas refluxing device is applied, may be a reciprocating engine. Further, the engine may generally include a cylinder block, a cylinder head, a cylinder head-cover and an oil pan.

The crankcase and the cylinder head cover formed by the cylinder block and the oil pan may communicate with each other through a passage provided in the cylinder block.

The intake air passage may be connected to an intake port of the cylindrical head, and an exhaust passage is connected to an exhaust port of the cylinder head. Further, an air cleaner for purifying air may be provided at an inlet of the intake air passage.

The supercharger may include a compressor provided in the intake air passage for increasing the pressure of the intake air, a turbine provided in the exhaust gas passage and a rotational shaft that connects between the compressor and the turbine so as to rotate them together.

The supercharger increases a pressure of the intake air in the intake air passage, as the turbine rotates by the exhaust gas flowing through the exhaust air passage and the compressor is rotated together with the turbine via the rotational shaft.

In addition, the compressor may be located on the downstream side of the air cleaner in the intake air passage.

An exhaust gas bypass passage may be arranged in the exhaust air passage to bypass the turbine. In the exhaust gas bypass passage, a wastegate valve, the opening degree of which is adjusted by a diaphragm type actuator, may be disposed. In this case, it is possible to adjust the flow of the exhaust gas flowing through the exhaust gas bypass passage by the wastegate valve. Therefore, the flow rate of the exhaust gas supplied to the turbine is adjusted, the rotational speed of the turbine and the compressor is adjusted, and the supercharging of the intake air by the supercharger is adjusted.

In the intake air passage, an intercooler may be provided between the compressor of the supercharger and the throttle valve. The intercooler cools down the intake air, which is pressurized by the compressor, to a suitable temperature.

The blow-by gas refluxing device is provided with the intake air bypass passage that connects between the upstream side and the downstream side of the supercharger in the intake air passage.

The intake air bypass passage bypassing the compressor may be disposed between a part of the intake air passage proximal to and on the downstream side of the compressor, where the supercharging pressure is high, and a part of the intake air passage on the upstream side of the compressor.

The inlet of the first blow-by gas refluxing passage is connected to the cylinder block or the cylinder head cover of the engine, and the outlet of the first blow-by gas refluxing passage is connected to the intake air bypass passage.

If the first blow-by gas refluxing passage is not provided, it is not possible to reflux the blow-by gas sufficiently when the throttle opening degree is small and when the throttle opening degree is large.

Further, the first blow-by gas refluxing passage or the intake air bypass passage has the first backflow prevention device for preventing the blow-by gas from flowing from the first blow-by gas refluxing passage into the cylinder block or the cylinder head cover.

The first backflow prevention device may prevent the backflow from the first blow-by gas refluxing passage to the side of the engine when the pressure in the intake air bypass passage is larger than the internal pressure of the crankcase or the internal pressure of the cylinder head cover.

Further, the first backflow prevention device may have any construction as long as it can prevent the blow-by gas from flowing from the first blow-by gas refluxing passage to the side of the engine side. For example, a jet pump or a check valve may be used as the first backflow prevention device.

Further, the position of the first backflow prevention device is not limited as long as it is arranged in the first blow-by gas refluxing passage or the intake air bypass passage. For example, the first backflow prevention device may be disposed at a connecting part between the first blow-by gas refluxing passage and the intake air bypass passage.

If no first backflow prevention device is provided, it may be possible that the blow-by gas flows backward toward the cylinder block or the cylinder head cover when the pressure in the intake air bypass passage is higher than the pressure in the crankcase or the cylinder head cover. Therefore, ventilation of the blow-by gas may not be performed sufficiently.

Further, the outlet of the second blow-by gas refluxing passage is connected to the intake air passage on the downstream side of the throttle valve.

If no second blow-by gas refluxing passage is provided, it may be possible that ventilation of the blow-by gas is not performed sufficiently during the idling operation and when the throttle opening degree is small.

The inlet of the second blow-by gas refluxing passage may be connected to the cylinder block, or as will explained later, to the first blow-by gas refluxing passage.

Further, the second blow-by gas refluxing passage has the second backflow prevention device for preventing the blow-by gas from flowing from the second blow-by gas refluxing passage into the cylinder block or the cylinder head cover.

The second backflow prevention device may have any construction as long as it can prevent flow of the blow-by gas from flowing from the second blow-by gas refluxing passage to the side of the engine. For example, a check valve can be used.

In addition, not only the case where the pressure P3 is a positive pressure but also the case where the pressure P3 is higher than the internal pressure of the crankcase or the cylinder head cover, potential backflow from the second blow-by gas refluxing passage to the engine side may be prevented by the second backflow prevention device.

Further, the position of the second backflow prevention device is not limited as long as it is arranged in the second blow-by gas refluxing passage. For example, the second backflow prevention device may be arranged proximal to the inlet of the second blow-by gas refluxing passage.

If no second backflow prevention device is provided, ventilation of the blow-by gas may not be sufficiently made because the blow-by gas may flow backward into the cylinder block or the cylinder head cover when the pressure on the downstream side of the throttle valve has become positive. In addition, if the pressure in the crankcase formed by the cylinder block and the oil pan increases, it may be possible that oil may leak to lower the durability of the engine.

The inlet of the second blow-by gas refluxing passage of the blow-by gas refluxing device may be connected to the first blow-by gas refluxing passage.

In this case, the number of pipelines necessary for the engine can be decreased, and therefore, the number of manufacturing steps and the manufacturing cost can be reduced.

Further, in this case, when the pressure P3 mentioned above is lower than the pressure within the engine, the blow-by gas is refluxed to the engine through the first blow-by gas refluxing passage and the second blow-by gas refluxing passage.

Further, the second blow-by gas refluxing passage may have a blow-by gas flow rate restriction device disposed on an upstream side of the second backflow prevention device.

In this case, it is possible to prevent the blow-by gas from being excessively refluxed into the engine.

As the blow-by gas flow rate restriction device, any device can be used as long as it can restrict the flow rate of the blow-by gas. For example, orifice and the like formed by reducing the diameter of the second blow-by gas refluxing passage can be used.

The flow rate restriction device may be arranged successively to or spaced from the second backflow prevention device.

The first backflow prevention device may be a jet pump thank can produce a negative pressure in the intake air bypass passage. The outlet of the first blow-by gas refluxing passage may be connected to the intake air bypass passage through the jet pump. In this case, it is possible not only to prevent the backflow from the first blow-by gas refluxing passage to the engine side but also to increase the blow-by gas flow rate refluxed to the engine when a pressure difference occurs in the intake air between the upstream side and the downstream side of the supercharger.

The jet pump may include a nozzle arranged on an air inlet side, a diffuser arranged on an air outlet side and a pressure reduction chamber arranged between the nozzle and the diffuser. Further the outlet of the first blow-by gas refluxing passage is connected to the pressure reduction chamber.

The jet pump may produce a negative pressure in the pressure reduction chamber by the action of air blown from the nozzle. Namely, when the supercharger is operated, a different in pressure of the intake air occurs between the upstream side and the downstream side of the supercharger because the compressor increases the pressure of the intake air. Therefore, different intake air pressures are applied to the nozzle of the jet pump and to the diffuser through the intake air bypass passage, so that the air is blown from the nozzle toward the diffuser to produce a negative pressure in the pressure reduction chamber. Further, due to the application of the negative pressure of the pressure reduction chamber, the blow-by gas generated in the engine flows into the intake air passage through the first blow-by gas refluxing passage, the jet pump and the intake air bypass passage. Further, as the negative pressure is produced in the pressure reduction chamber, the flow from the intake air bypass passage to the first blow-by gas refluxing passage can be prevented.

Further, the value of the negative pressure produced in the pressure reduction chamber may vary depending on the value of the supercharging pressure of the supercharger. Namely, as the supercharging pressure of the supercharger increases, the negative pressure produced in the pressure reduction chamber increases accordingly, and therefore, the flow rate of the blow-by gas flowing from the engine to the first blow-by gas refluxing passage increases and the flow rate of the blow-by gas flowing into the intake air passage increases.

The intake air bypass passage may have an opening and closing valve disposed therein. In this case, when the supercharger is operated, the air flows into the intake air bypass passage by opening the intake air bypass passage by the opening and closing valve. Closing the opening and closing valve can block the flow of the air into the intake air bypass passage. Therefore, it is possible to selectively allow the blow-by gas to flow into the intake air bypass passage so as to be refluxed to the engine.

Further, the first blow-by gas refluxing passage may be provided with a blow-by gas flow rate adjusting valve. In this case, the flow rate of the blow-by gas flowing through the first blow-by gas refluxing passage can be adjusted. Therefore, it is possible to prevent the blow-by gas from being excessively refluxed to the engine.

The blow-by gas refluxing device may further include a fresh air introduction passage connected to the cylinder block or the cylinder head cover for introducing fresh air thereinto. In this case, ventilation of inside of the crankcase or the cylinder head cover can be effectively performed, and the effect of suppressing deterioration of the engine oil due to the blow-by gas can be further improved.

An inlet of the fresh air introduction passage may be connected to the intake air passage on the upstream side of the supercharger, and the outlet of the fresh air introduction passage may be connected to the cylinder block or the cylinder head cover.

FIRST EXAMPLE

A first example t of a blow-by gas refluxing device will be explained referring to FIG. 1. FIG. 1 is a schematic view of an engine system including a blow-by gas refluxing device 1.

As shown in FIG. 1, the blow-by gas refluxing device 1 is provided for an engine 3 having a supercharger 21 and a throttle valve 22 arranged downstream of the supercharger 21 in an intake air passage 2. The blow-by gas refluxing device 1 is provided with a blow-by gas refluxing passage 4 that refluxes blow-by gas generated by the engine 3 to the engine 3 via the intake air passage 2. The blow-by gas refluxing device 1 is further provided with an intake air bypass passage 23 that communicates with the intake air passage 2 at the upstream and the downstream of the supercharger 21.

The blow-by gas refluxing passage 4 is provided with a first blow-by gas refluxing passage 41 and a second blow-by gas refluxing passage 42. The inlet of first blow-by gas refluxing passage 41 is connected to a cylinder block 31 or a cylinder head cover 32 and its outlet is connected to the intake air bypass passage 23.

The first blow-by gas refluxing passage 41 or the intake air bypass passage 23 is provided with a first backflow preventing means 24 for preventing flow of the blow-by gas from the first blow-by gas refluxing passage 41 into the cylinder block 31 or the cylinder head cover 32.

The outlet of the second blow-by gas refluxing passage 42 is connected to the intake air passage 2 at the downstream of throttle valve 22. The second blow-by gas refluxing passage 42 is provided with a second backflow preventing device 421 for preventing flow of the blow-by gas from the second blow-by gas refluxing passage 42 to the cylinder block 31 or the engine head cover 32.

The engine system including the blow-by gas refluxing device 1 is provided with the engine 3 of a reciprocating type. As shown in FIG. 1, the engine 3 is constructed with the cylinder block 31, a cylinder head 35, the cylinder head cover 32 and an oil pan 36. Further, an intake port 33 of the cylinder head 35 is connected to the intake air passage 2, and an exhaust port 34 of the cylinder head 35 is connected to an exhaust gas passage 71. In addition, an air cleaner 25 is provided at the inlet of the intake air passage 2.

The supercharger 21 is arranged in the intake air passage 2 and includes a compressor 211 for increasing the pressure of the intake air, a turbine 212 arranged in the exhaust gas passage 71 and a rotational shaft 213 that connects the compressor 211 and the turbine 212 in a manner that the compressor and the turbine 212 can rotate together.

The supercharger 21 increases the pressure in the intake air passage 2 as the turbine 212 is rotated by the flow of the exhaust gas flowing through the exhaust gas passage 71 to rotate the compressor 211 together via the rotational shaft 213. In other words, it is constituted to supercharge the intake air. In addition, the compressor 211 is arranged downstream of the air cleaner 25 in the intake air passage 2.

In communication with the exhaust gas passage 71, an exhaust gas bypass passage 72 is provided that bypasses the turbine 212 at a position adjacent to supercharger 21. In this exhaust gas bypass passage 72, a wastegate valve 73 is provided. The Opening of the wastegate valve 73 can be adjusted by a diaphragm-type actuator 74. As the exhaust gas flowing through the exhaust gas bypass passage 71 is adjusted by the wastegate valve 73, the flow rate of the exhaust gas supplied to the turbine 212 is adjusted, the rotational speed of the turbine 212 and the compressor 211 is adjusted, and the supercharging by the supercharger 21 is adjusted.

In the intake air passage 2, an intercooler 26 is provided between the compressor 211 of the supercharger 21 and the engine 3. This intercooler 26 is provided for cooling down the intake air pressurized by compressor 211 to a suitable temperature. In the intake air passage 2, a surge tank 27 is provided between the intercooler 26 and the engine 3. On the upstream side of the surge tank 27, the throttle valve 22 is provided.

Upstream side and downstream side of the supercharger 21 in the intake air passage 2 are connected to each other by the intake air bypass passage 23. That is, the intake air bypass passage 23 is provided to bypass the compressor 211 and communicates between a part of the intake air passage 2 proximate and downstream of the compressor 211, where the supercharged pressure is high, and a part of the intake air passage 2 upstream of the compressor 211. A jet pump 24 is provided in the intake air bypass passage 23 as a first back flow prevention device and generates a negative pressure by utilizing the air flowing through the passage 23.

Figure 2:
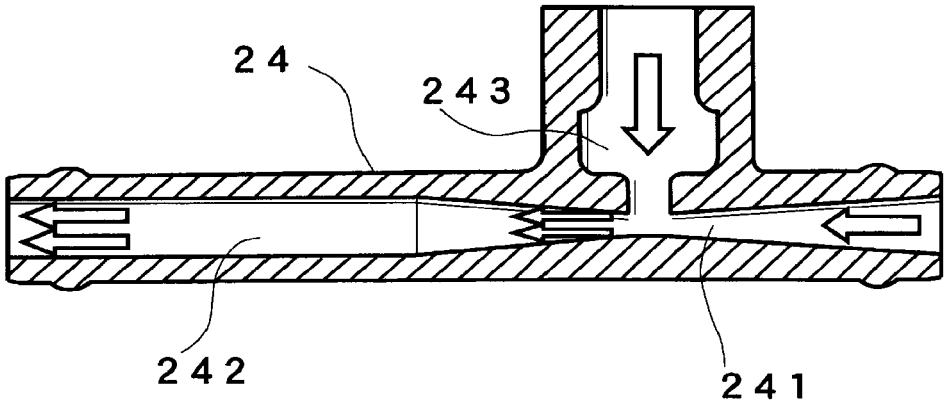
FIG. 2 is a sectional view showing a jet pump of the first example.

In FIG. 2, a schematic structure of the jet pump 24 is shown in a sectional view. The jet pump 24 includes a nozzle 241 provided on an air inlet side, a diffuser 242 provided on an air outlet side, and a pressure reduction chamber 243 provided between the nozzle 241 and the diffuser 242.

As shown in FIG. 1, the pressure reduction chamber 243 of the jet pump 24 is connected to the outlet of the first blow-by gas refluxing passage 41. In other words, the outlet of the first blow-by gas refluxing passage 41 is connected with the intake air bypass passage 23 via the jet pump 24. The inlet of the first blow-by gas refluxing passage 41 is connected to the cylinder block 31 of the engine 3.

The jet pump 24 prevents flow of air from the intake air bypass passage 23 to the first blow-by gas refluxing passage 41 and also prevents flow of the blow-by gas from the first blow-by gas refluxing passage 41 to the cylinder block 31 or the cylinder head cover 32.

The jet pump 24 serves to produce a negative pressure in the pressure reduction chamber 243 by utilizing the flow of air blown out from the nozzle 241. Thus, because intake air is pressurized by the compressor 211 during the operation of the supercharger 21, a pressure difference is produced between the upstream side and the downstream side of the compressor 211 in the intake air passage 2. Therefore, a difference may be produced between the intake air pressure applied at the nozzle 241 and that applied at the diffuser 242 of the jet pump 24 through the intake air bypass passage 23, so that air is blown out from the nozzle 241 toward the diffuser 242 to thereby produce a negative pressure in the pressure reduction chamber 243. The value of the negative pressure changes depending on the value of the supercharging pressure produced by the supercharger 21.

Because the negative pressure is produced in the pressure reduction chamber 243, even in the case that the pressure in the intake air bypass passage 23 is greater than the pressure in the crankcase 39, only the introduction of the blow-by gas from the first blow-by gas refluxing passage 41 to the intake air bypass passage 23 is caused, and it is possible to prevent the intake air from flowing from the intake air bypass passage 23 to the first blow-by gas refluxing passage 41. In addition, because a negative pressure is produced in the pressure reduction chamber 243, the blow-by gas generated by the engine 3 flows into the intake air passage 2 through the first blow-by gas refluxing passage 41, the jet pump 24 and the intake air bypass passage 23.

In addition, the outlet of the second blow-by gas refluxing passage 42 is connected to the intake air passage 2 on the downstream side of the throttle valve 22. The inlet of second blow-by gas refluxing passage 42 is connected to the cylinder block 31 of the engine 3. Further, a check valve 421 is provided as a second back flow prevention device which prevents the blow-by gas from flowing from the second blow-by gas refluxing passage 42 into the cylinder block 31 or the cylinder head cover 32.

Figure 3:
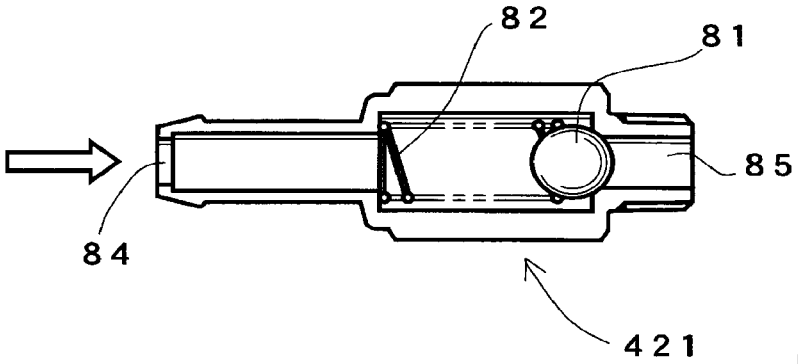
FIG. 3(*a*) is a sectional view showing a check valve of the first example.
Figure 3:
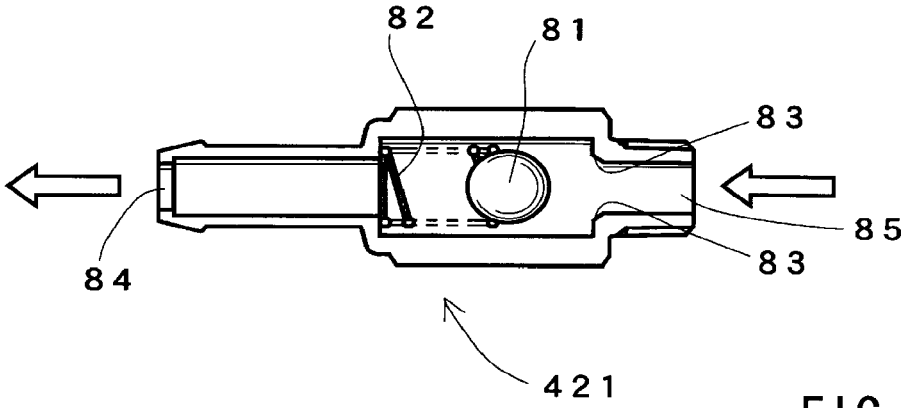

FIGS. 3(*a*) and 3(*b*) show sectional views of the check valve 421. FIG. 3(*a*) shows a closed state of the check valve 421 and FIG. 3(*b*) shows an open state of the check valve 421.

A valve element 81 of the check valve 421 is biased toward a seat surface 83 by a spring 82. If the internal pressure of the surge tank 27 is greater than the internal pressure of the crankcase 39 or the cylinder head cover 32, the valve element 81 contacts the seat surface 83 to close the valve 421 as shown FIG. 3(*a*). Therefore, the check valve 421 prevents backflow from the second blow-by gas refluxing passage 42 toward the engine side by blocking off the flow of the blow-by gas from an opening 84 on the side of the surge tank 27 toward an opening 85 on the side of the cylinder block 31. On the other hand, when the inner pressure of the surge tank 27 becomes equal to or lower than the internal pressure of the crankcase 39 or the cylinder head cover 32, the valve element 81 moves toward the opening 85 on the side of the surge tank 27, so that the valve 421 is opened to permit flow of the blow-by gas into the surge tank 27.

An orifice 422 is provided on the upstream side of the check valve 421 and serves as a blow-by gas flow rate restriction device that restricts the flow rate of the blow-by gas flowing into the second blow-by gas refluxing passage 42.

In addition, according to this example, a fresh air introducing passage 75 is provided between the engine 3 and the intake air passage 2 to introduce fresh air into inside of the cylinder head cover 32 and inside of the crankcase 39 formed by the cylinder block 31 and the oil pan 36.

The inlet of the fresh air introducing passage 75 is connected to the intake air passage 2 at a position on the downstream side of the air cleaner 25, and the outlet of the fresh air introducing passage 75 is connected to the cylinder head cover 32.

Further, inside of the head cover 32 is communicated with inside of the crankcase 39 through a communicating path 38 provided in the engine 3.

Figure 4:
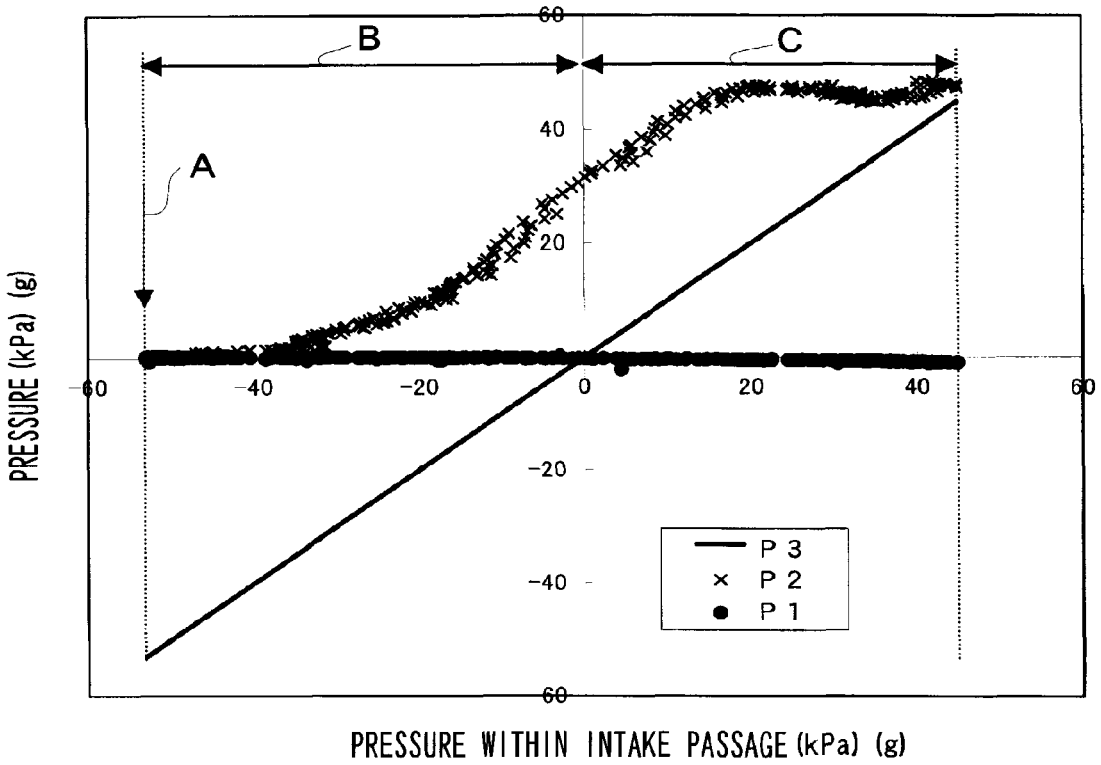
FIG. 4 is a graph showing the relationship between pressures P1, P2 and P3 in the first example.

FIG. 4 shows a relationship between pressures P1, P2 and P3 throughout the entire operating range, wherein P1 is a pressure on the upstream side of the supercharger 21 in the intake air passage 2, P2 is a pressure within a path from the downstream side of the supercharger 21 to the throttle valve 22 in the intake air passage 2, and P3 is a pressure on the downstream side of the throttle valve 22 in the intake air passage 2. FIG. 4 shows the relationship within the operational range of the engine 3 from 800 to 3,200 RPM of the engine rotational speed. The relationship for the operational range more than 3,200 RPM is not shown, because in this range, values of pressures P1, P2 and P3 that will be explained later may be substantially equal to the values of these pressures shown at the right end of the graph of FIG. 4. In FIG. 4, a reference of a horizontal axis is a value of the pressure P3 (kPa, gauge pressure) on the downstream side of the throttle valve 22 in intake air passage 2, and a reference of a vertical axis is values of the pressures P1 and P2 (kPa, gauge pressure). In FIG. 4, the straight line indicates the pressure P3, a symbol ● indicates the pressure P1, and a symbol × indicates the pressure P2. In FIG. 4, position A corresponds to an engine idling range, a range B corresponds to a range where an open degree of the throttle valve 22 is small, and a range C corresponds to a range where the open degree of the throttle valve 22 is large.

As can be seen from FIG. 4, with the blow-by gas refluxing device 1, the pressure P1 in the intake air passage 2 on the upstream side of the supercharger 21 becomes equal to an atmospheric pressure throughout the entire operating range.

During the idling operation, the rotational speed of the compressor 211 is low, and therefore, the pressure P2 within the path from the downstream side of the supercharger 21 to the throttle valve 22 in the intake air passage 2 becomes to be equal to or substantially equal to an atmospheric pressure, while the pressure P3 on the downstream side of throttle valve 22 in the intake air passage 2 becomes to be a negative pressure. Namely, the relationship "P1=P2>P3" is resulted during the idling operation.

When the degree of opening of the throttle valve 22 is small, the rotational speed of the compressor 211 increases, so that the pressure P2 increases and becomes positive, while the pressure P3 is kept to be negative. Namely, the relationship "P2>P1>P3" results when the degree of opening of the throttle valve 22 is small.

When the degree of opening of the throttle valve 22 is large, the rotational speed of the compressor 211 increases, so that the pressure P2 further increases, while the pressure P3 becomes positive to be larger than the pressure P1 and to be substantially equal to the pressure P2. Namely, the relationship "P2≥P3>P1" results when the opening degree of the throttle valve 22 is large.

In this way, according to the blow-by gas refluxing device 1 of this example, during the idling operation (where the relationship "P1=P2>P3" results), a negative pressure (corresponding the pressure P3) produced in the surge tank 27 is applied to the second blow-by gas refluxing passage 42, and the blow-by gas leaked from the combustion chamber 37 of the engine 3 to the inside of the cylinder block 31 flows into the surge tank 27 provided in the intake air passage 2 through the second blow-by gas refluxing passage 42. Namely, the blow-by gas can be refluxed to the engine 3 through the second blow-by gas refluxing passage 42 during the idling operation.

Further, at that time, the orifice 422 restricts the flow rate of the blow-by gas flowing from the engine 3 to the second blow-by gas refluxing passage 42.

Furthermore, as there is no substantial difference between the pressures P1 and P2, no substantial flow occurs in the intake air bypass passage 23, so that refluxing of the blow-by gas through the first blow-by gas refluxing passage 41 may not occur.

When the opening degree of the throttle valve 22 is small (where the relationship "P2>P1>P3" results), similar to the case during the idling operation, the pressure P3 is applied to the second blow-by gas refluxing passage 42, so that the blow-by gas of the engine 3 flows into the surge tank 27 provided in the intake air passage 2 through the second blow-by gas refluxing passage 42.

Further, between the upstream side and the downstream side of the supercharger 21 in the intake air passage 2, a pressure difference (due to the relationship "P2>P1") occurs, so that a pressure difference also occurs between opposite ends of the intake air bypass passage 23. By this pressure difference, air may flow into the intake air bypass passage 23, and by this flow of air, the blow-by gas generated by the engine 3 is introduced into the intake air passage 2 through the first blow-by gas refluxing passage 41 and the intake air bypass passage 23.

In particular, according to this example, the jet pump 23 is provided in the intake air bypass passage 23. Therefore, a negative pressure corresponding to the flow rate of air flowing in the intake air bypass passage 23 is produced in the pressure reduction chamber 243 of the jet pump 24. Therefore, the negative pressure produced by the jet pump 24 is applied to the outlet of the first blow-by gas refluxing passage 41. As a result, the blow-by gas that may be remained in the cylinder block 31 is effectively introduced into the intake air passage 2 via the first blow-by gas refluxing passage 41, the jet pump 24 and the intake air bypass passage 23.

Thereafter, the blow-by gas flown into the intake air passage 2 is refluxed into the combustion chamber 37 of the engine 3 after flowing through the intake air passage 2, etc.

Thus, when the opening degree of the throttle vale 22 is small, the blow-by gas can be refluxed to the engine 3 through the first blow-by gas refluxing passage 41 and also through the second blow-by gas refluxing passage 42.

Further, as the supercharged pressure produced by the supercharger 21 increases, the pressure difference between the upstream side and the downstream side of the supercharger 21 increases accordingly, and therefore, the flow rate of the blow-by gas flowing from the engine 3 to the first blow-by gas refluxing passage 41 increases, so that the flow rate of the blow-by gas flowing into the intake air passage 2 increases.

Thus, as the pressure difference between the upstream side and the downstream side of the supercharger 21 increases, the negative pressure generated by the jet pump 24 becomes larger accordingly, so that the flow rate of the blow-by gas flowing into the intake air passage 2 increases.

In addition, because the intake air bypass passage 23 is provided to bypass a part of the intake air passage 2, the intake air bypass passage 23 does not affect to resistance of flow of air in the intake air passage 2. Accordingly, during the operation of the supercharger 21, the blow-by gas can be refluxed to the combustion chamber 37 without causing increase in resistance of flow of the intake air in the intake air passage 2, and the flow rate of the refluxing blow-by gas can be increased according to increase of the supercharging pressure.

In addition, during this operation, the internal pressure of the intake air bypass passage 23 may become larger than the internal pressure of the cylinder block 31 and the cylinder head cover 32. However, potential backflow of the blow-by gas into the engine 3 can be prevented by the first backflow prevention device (jet pump) 24 provided in the intake air bypass passage 23. Thus, the negative pressure generated in the pressure reduction chamber 243 causes only the introduction of the blow-by gas from the first blow-by gas refluxing passage 41 to the intake air bypass passage 23, and therefore, flow from the intake air bypass passage 23 to the first blow-by gas refluxing passage 41 can be prevented.

When the opening degree of the throttle valve 22 is large (where the relationship "P2≥P3>P1" results), similar to the case when the throttle opening degree is small, between the upstream side and the downstream side of the supercharger 21 in the intake air passage 2, a pressure difference (due to the relationship "P2>P1") occurs and a pressure difference also occurs between opposite ends of the intake air bypass passage 23. By this pressure difference, air may flow into the intake air bypass passage 23, and by this flow of air, the blow-by gas generated by the engine 3 is introduced into the intake air passage 2 through the first blow-by gas refluxing passage 41 and the intake air bypass passage 23.

In this case, the pressure P3 may become positive. However, potential backflow to the engine 3 can be prevented by the second backflow prevention device (check valve) 421. That is, when the throttle opening degree is large, the blow-by gas can be refluxed to the engine 3 through the first blow-by gas refluxing passage 41.

In this way, according to the above example, in any of the operating conditions of the engine 3 including the condition during the idling operation, the condition when the throttle opening degree is small and the condition when the throttle opening degree is large, the blow-by gas can be refluxed to the engine 3. Namely, even in the case that a pressure at the outlet on the side of the intake air passage 2 of the blow-by gas refluxing passage 4 is greater than the internal pressure of the crankcase 39 or the cylinder head cover 32, the blow-by gas refluxing device 1 can prevent backflow of the blow-by gas from the intake air passage 2 to the engine 3 through the blow-by gas refluxing passage 4 and can achieve ventilation properly from inside of the cylinder block 31 and the cylinder head cover 32 thought the entire operating range.

Although the jet pump 24 is provided in the intake air bypass passage 23 as the first backflow prevention device in the above example, the first backflow preventing device is not necessarily to be the jet pump but may be a check valve or any other suitable device.

SECOND EXAMPLE

Figure 5:
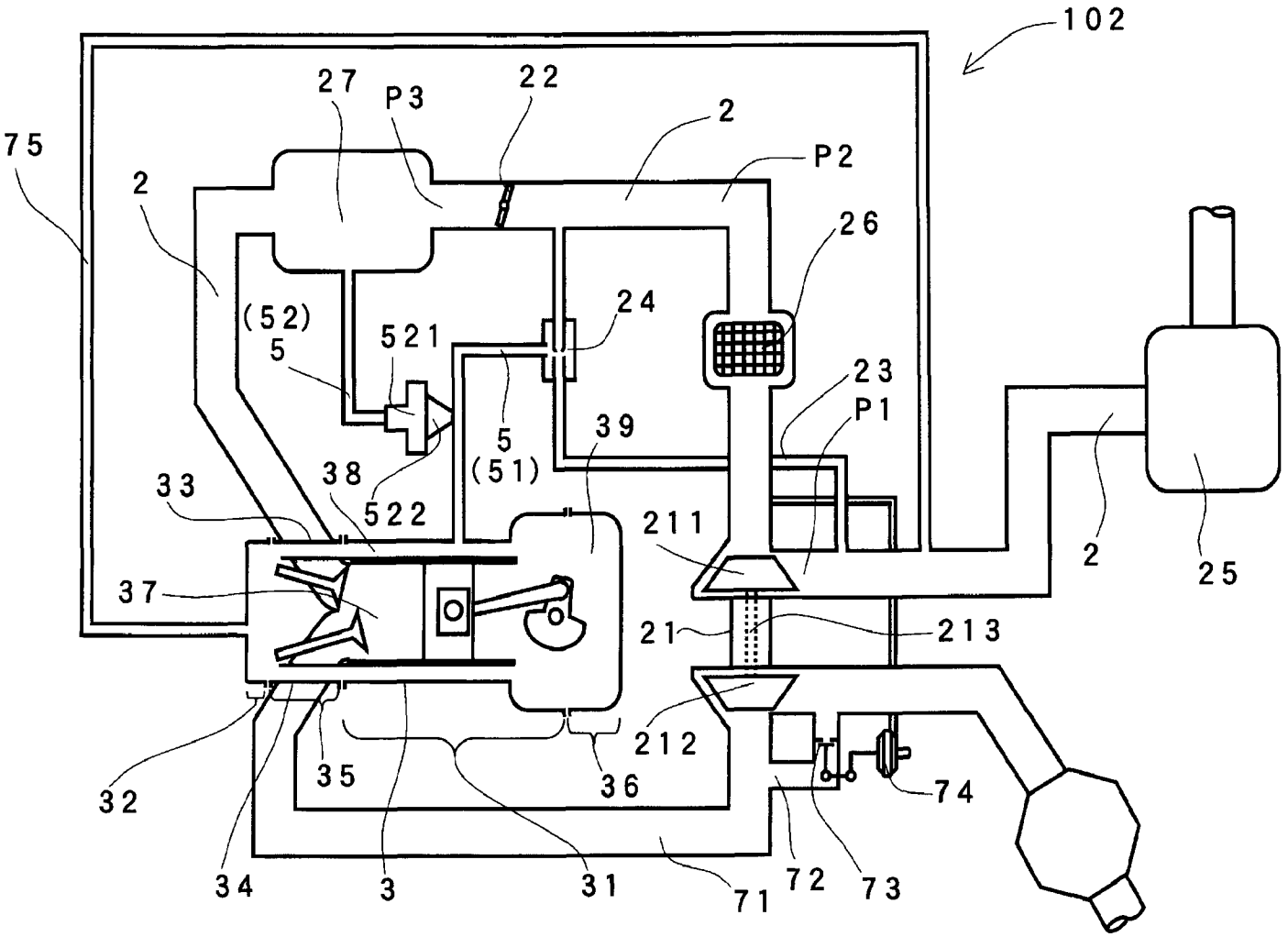
FIG. 5 is an explanatory view of an engine system incorporating a blow-by gas refluxing device according to a second example.

As shown in FIG. 5, in a blow-by gas refluxing device 102 of this embodiment, the blow-by gas refluxing passage 4 of the first example is replaced with a blow-by gas refluxing passage 5 including a first blow-by gas refluxing passage 51 and a second blow-by gas refluxing passage 52 having an outlet connected to the first blow-by gas refluxing passage 51. The second blow-by gas refluxing passage 52 has a check valve 521 as a second backflow prevention device that prevents flow of the blow-by gas from the second blow-by gas refluxing passage 52 into the first blow-by gas refluxing passage 51. Further, on the upstream side of the check valve 521, an orifice 522 is provided as a blow-by gas flow rate restricting device which restricts the flow rate of the blow-by gas flowing into the second blow-by gas refluxing passage 52. The other constitution is the same as the first example.

According to the blow-by gas refluxing device 102 of this embodiment, the number of pipelines required for connecting to the engine 3 can be reduced, so that the number of manufacturing steps and the manufacturing cost can be reduced. In addition, the same operations and effects as in the first example can be achieved.

In the case of this example, when the negative pressure (corresponding to the pressure P3) produced in the surge tank 27 is lower than the internal pressure of the engine 3 (i.e., during the idling operation and when the opening degree of the throttle valve 22 is small), the blow-by gas can be refluxed to the engine 3 via a part of the first blow-by gas refluxing passage 41 and the second blow-by gas refluxing passage 42.

Figure 6:
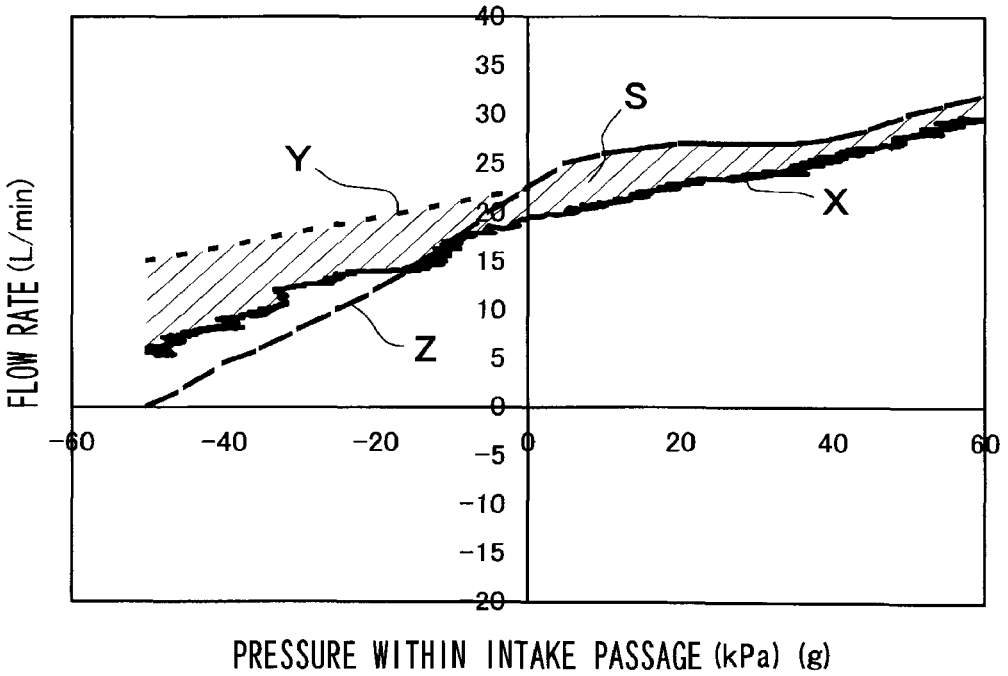
FIG. 6 is a graph showing a characteristic of a flow rate of blow-by gas given by the blow-by gas refluxing device of the second example.

FIG. 6 shows a characteristic of a flow rate of the blow-by gas given by the blow-by gas refluxing device 102 according to this example. In FIG. 6, a horizontal axis indicates the pressure P3 (kPa, gauge pressure) on the downstream side of the throttle valve 22 in the intake air passage 2 and a vertical axis indicates a flow rate (L/min). In FIG. 6, a curved line X indicates a flow rate of the generated blow-by gas, a curved line Y indicates a flow rate of the blow-by gas refluxed through the first blow-by gas refluxing passage 51 and the second blow-by gas refluxing passage 52, and a curved line Z indicates a flow rate of the blow-by gas refluxed through the first blow-by gas refluxing passage 51. Further, a range S (shaded area) indicates a flow rate of fresh air supplied from the fresh air introducing passage 75.

As can be seen from FIG. 6, during the idling operation and when the throttle opening degree is small, in other words, when the intake air pressure is −60 to 0 kPa, ventilation is achieved through the first blow-by gas refluxing passage 51 and the second blow-by gas refluxing passage 52. On the other hand, when the throttle opening degree is large, in other words, when the intake air pressure is 0 to 60 kPa, ventilation is achieved through the first blow-by gas refluxing passage 51.

As can be also seen from FIG.6, according to the blow-by gas refluxing device 102 of this example, during the idling operation, when the throttle opening degree is small, and when the throttle opening degree is large, in other words, throughout the entire operating range, discharge and ventilation of the blow-by gas remaining in the cylinder block 31 and the cylinder head cover 32 can be achieved.

Further, it can be understood that the flow rate of the refluxing blow-by gas increases as the supercharged pressure increases.

The same flow rate characteristic of the blow-by gas as shown in FIG. 6 can be also be achieved by the blow-by gas refluxing device 1 of the first example.

THIRD EXAMPLE

Figure 7:
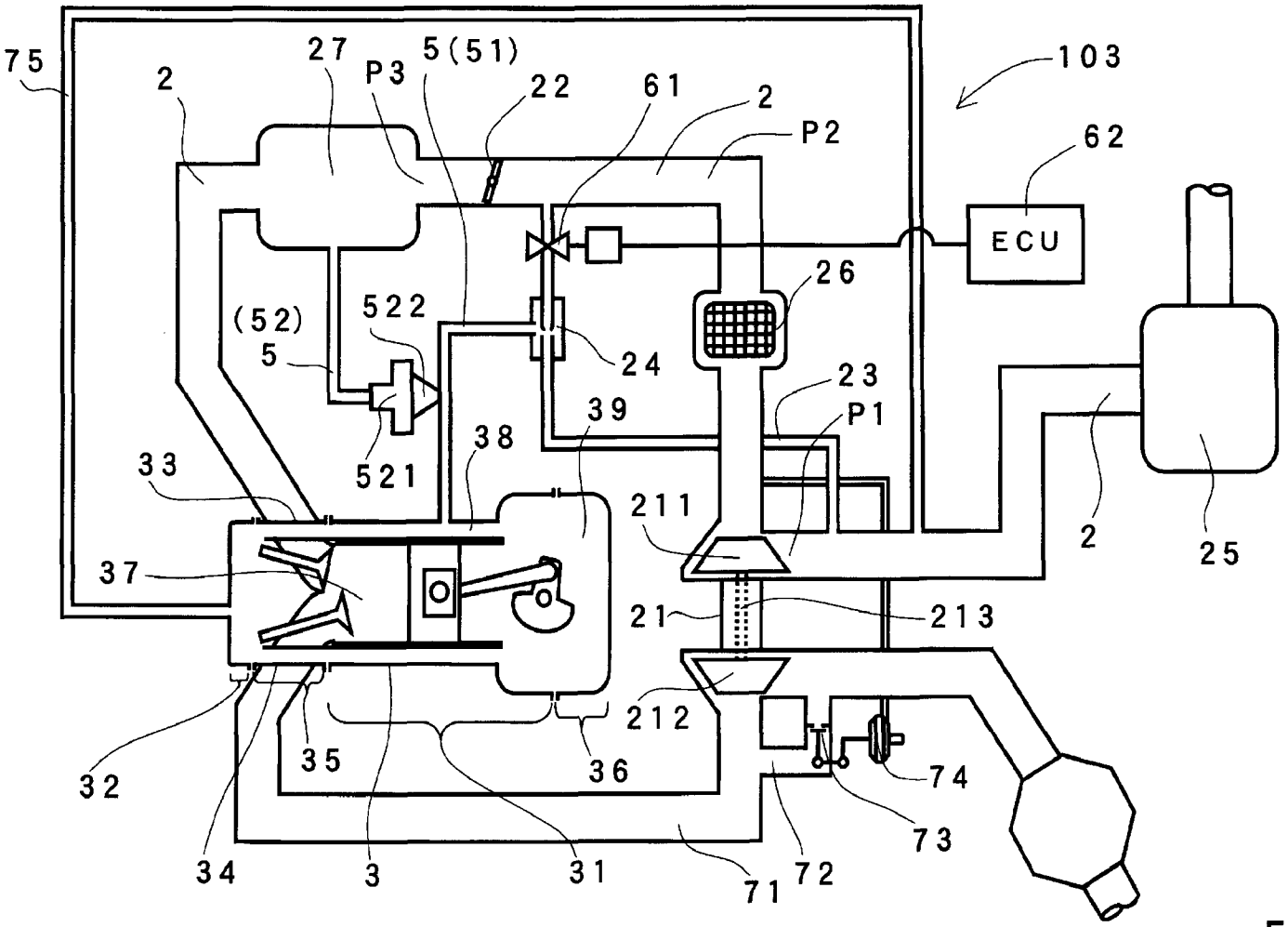
FIG. 7 is an explanatory view of an engine system incorporating a blow-by gas refluxing device according to a third example.

As can be seen in FIG. 7, in a blow-by gas refluxing device 103 of a third example, a vacuum switching valve (hereinafter called "VSV") 61 is provided in the intake air bypass passage 23 of the second example, and the VSV 61 is controlled according to the condition of the engine 3 by an electronic control unit (hereinafter called "ECU") 62. The other constitution is the same as the second example.

Values, such as a rotational speed of the engine 3 and the pressure of the intake air, may be detected by various sensors (not shown) arranged at the engine 3 and are input to the ECU 62, and the ECU 62 controls VSV 61 based on the detected values. The VSV 61 may be called an opening and closing valve.

Figure 8:
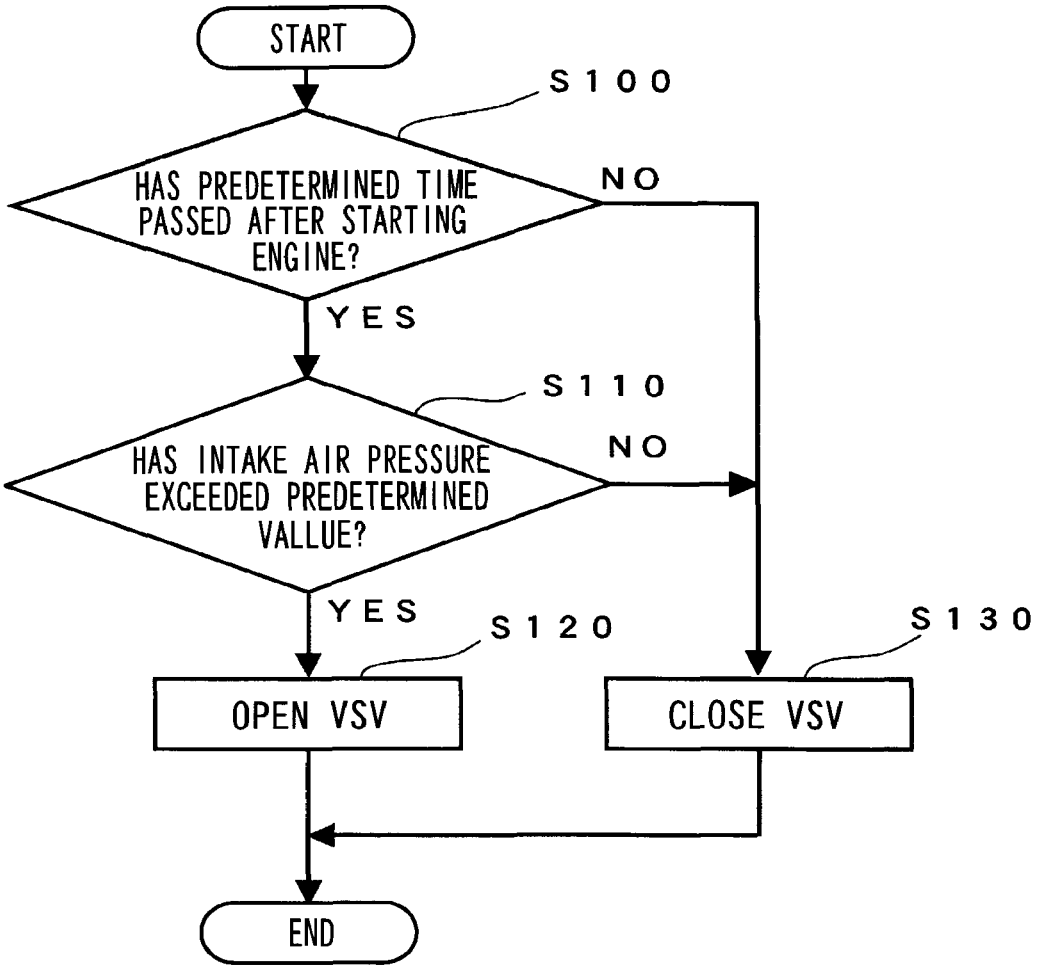
FIG. 8 is a flowchart of a control program executed by an ECU according to the third example.

FIG. 8 shows a flowchart of a control program executed by the ECU 62. When the process is passed to this routine, the ECU 62 first determines in Step 100 (S100) whether or not a predetermined time has passed after starting the engine 3. If the result of determination is NO, the process proceeds to Step 130 (S130), where the VSV 61 is closed based on the judgment that the engine 3 has not yet been warmed up. As a result, the intake air bypass passage 23 is closed by the VSV 61, and flow of air through the intake air bypass passage 23 is blocked, so that a negative pressure is not produced by the jet pump 24.

On the other hand, if the result of determination in Step 100 (S100) is YES, the process proceeds to Step 110 (S110), where the ECU 62 determines whether or not the intake air pressure exceeds a predetermined value. If the result of determination is NO, the process proceeds to Step 130 (S130), where the VSV 61 is closed as described above based on the judgment that the supercharger 21 is not activated after the engine 3 has been warmed up.

On the other hand, if the result of determination in Step 110 (S110) is YES, the process proceeds to Step 120 (S120), where the VSV 61 is opened based on the judgment that the supercharger 21 is activated after completion of warming up of the engine 3. As a result, the intake air passage 23 is opened by the VSV 61, and air flows into the intake air passage 23 at a flow rate depending on the value of the supercharged pressure, and a negative pressure depending on the supercharged pressure is produced at the jet pump 24. Therefore, the blow-by gas is exhausted from the cylinder block 31 to the first blow-by gas refluxing passage 41 depending on the value of the supercharged pressure. The blow-by gas is thereafter refluxed into the combustion chamber 37 through the jet pump 24, the intake air refluxing passage 41 and the intake air passage 2.

Consequently, in this example, if the intake air bypass passage 23 is opened by the VSV 61 depending on the operating condition of the engine 3, air flows into the intake air bypass passage 23 to produce a negative pressure by the jet pump 24. On the other hand, if the intake air bypass passage 23 is closed by the VSV 61 depending on the operating condition of engine 3, flow of air in the intake air bypass passage 23 is blocked, and therefore, a negative pressure is not produced by the jet pump 24. For this reason, depending on the operating condition of the engine 3, namely when needed, the blow-by gas can be flown from the cylinder block 31 into the intake air bypass passage 23 through the first blow-by gas refluxing passage 41 and further into the combustion chamber 37. In the other aspect, the same operations and effects as the second example can be achieved.

FOURTH EXAMPLE

Figure 9:
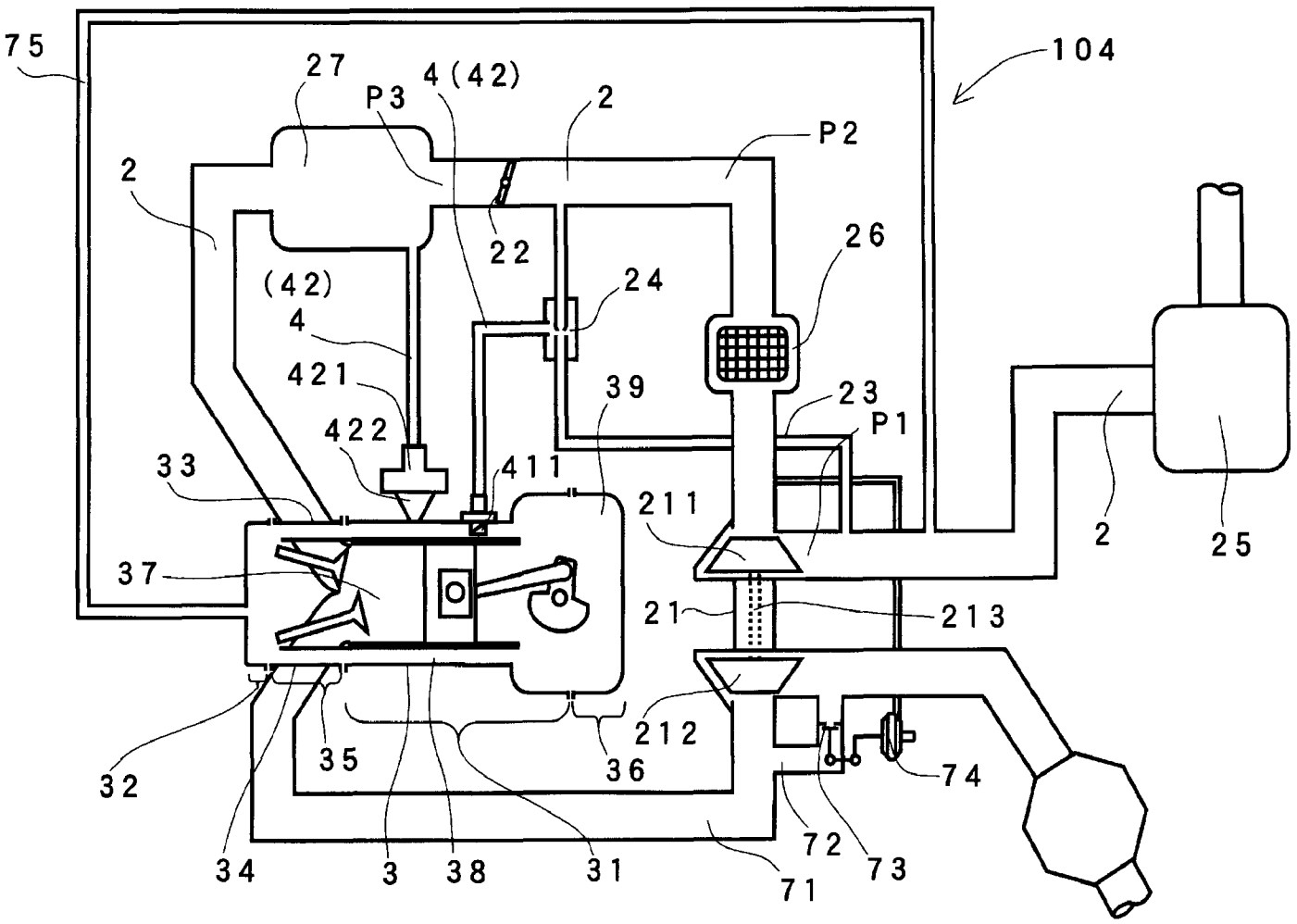
FIG. 9 is an explanatory view of an engine system including a blow-by gas refluxing device according to a fourth example.

As can be seen in FIG. 9, a blow-by gas refluxing device 104 of this example is configured to provide a PCV valve (positive crankcase ventilation valve) 411 in the first blow-by gas refluxing passage 41 of the first example. The other construction is the same as the first example.

More specifically, according to the blow-by gas refluxing device 104 of this example, the PCV valve 411 is disposed at the cylinder block 31 and serves as a blow-by gas flow rate adjusting valve positioned at the inlet of the first blow-by gas refluxing passage 41.

Therefore, the flow rate of the blow-by gas flowing into the first blow-by gas refluxing passage 41 can be properly adjusted by the PCV valve 411. As a result, it is possible to prevent the blow-by gas from excessively flowing into the combustion chamber 37 through the first blow-by gas refluxing passage 41. In the aspects, the operations and effects are the same as the first example.

What is claimed is:

1. A blow-by gas refluxing device provided for an engine system including an engine, an intake air passage, and a supercharger and a throttle valve each disposed in the intake air passage, the throttle valve being disposed on a downstream side of the supercharger in the intake air passage, the blow-by gas refluxing device comprising:

a blow-by gas refluxing passage configured to allow blow-by gas produced in the engine to flow into the intake air passage and to be refluxed into the engine;

an intercooler disposed in the intake air passage at a position on a downstream side of the supercharger and on an upstream side of the throttle valve;

an intake air bypass passage connecting between an upstream side of the supercharger and a downstream side of the intercooler in the intake air passage;

wherein the blow-by gas refluxing passage comprises a first blow-by gas refluxing passage and a second blow-by gas refluxing passage;

wherein the first blow-by gas refluxing passage has an inlet and an outlet, the inlet being connected to at least one of a cylinder block and a cylinder head cover of the engine and the outlet being connected to the intake air bypass passage; and wherein the second blow-by gas refluxing passage has an outlet connected to the intake air passage on the downstream side of the throttle valve; and a jet pump capable of producing a negative pressure in the intake air bypass passage;

wherein the outlet of the first blow-by gas refluxing passage is connected to the intake air bypass passage via the jet pump.

2. The blow-by gas refluxing device as in claim 1, wherein:

the second blow-by gas refluxing passage has a backflow prevention device disposed therein for preventing the blow-by gas from flowing from the second blow-by gas refluxing passage into the at least one of the cylinder block and the cylinder head cover.

3. The blow-by gas refluxing device as in claim 2, wherein the second blow-by gas refluxing passage has a blow-by gas flow rate restriction device disposed therein on an upstream side of the backflow prevention device.

4. The blow-by gas refluxing device as in claim 1, wherein the second blow-by gas refluxing passage has an inlet connected to the first blow-by gas refluxing passage.

5. The blow-by gas refluxing device as in claim 1, wherein the intake air bypass passage has an opening and closing valve disposed therein.

6. The blow-by gas refluxing device as in claim 1, wherein the first blow-by gas refluxing passage has a blow-by gas flow rate adjusting valve disposed therein.

7. The blow-by gas refluxing device as in claim 1, further comprising a fresh air introduction passage connected to the at least one of the cylinder block and the cylinder head cover for introducing fresh air thereinto.

8. A blow-by gas refluxing device provided for an engine system including an engine, an intake air passage, and a supercharger and a throttle valve each disposed in the intake air passage, the throttle valve being disposed on a downstream side of the supercharger in the intake air passage, the blow-by gas refluxing device comprising:

a blow-by gas refluxing passage configured to allow blow-by gas produced in the engine to flow into the intake air passage and to be refluxed into the engine;

an intake air bypass passage connecting between an upstream side of the supercharger and a downstream side of the supercharger in the intake air passage;

wherein the blow-by gas refluxing passage comprises a first blow-by gas refluxing passage and a second blow-by gas refluxing passage;

wherein the first blow-by gas refluxing passage has an inlet and an outlet, the inlet being connected to at least one of a cylinder block and a cylinder head cover of the engine and the outlet being connected to the intake air bypass passage; and wherein the second blow-by gas refluxing passage has an outlet connected to the intake air passage on the downstream side of the throttle valve;

a jet pump capable of producing a negative pressure in the intake air bypass passage, wherein the outlet of the first blow-by gas refluxing passage is connected to the intake air bypass passage via the jet pump; and a blow-by gas flow rate control device disposed in the second blow-by gas refluxing passage.

9. The blow-by gas refluxing device as in claim 8, wherein the blow-by gas flow rate control device comprises a blow-by gas flow rate restriction device configured to restrict flow of the blow-by gas through the second blow-by gas refluxing passage.

10. The blow-by gas refluxing device as in claim 8, wherein the blow-by gas flow rate control device comprises a backflow prevention device configured to prevent the blow-by gas from flowing from the second blow-by gas refluxing passage into the at least one of the cylinder block and the cylinder head cover.

11. The blow-by gas refluxing device as in claim 8, wherein the blow-by gas flow rate control device comprises:

a blow-by gas flow rate restriction device configured to restrict flow of the blow-by gas through the second blow-by gas refluxing passage; and a backflow prevention device configured to prevent the blow-by gas from flowing from the second blow-by gas refluxing passage into the at least one of the cylinder block and the cylinder head cover;

wherein the blow-by gas flow rate restriction device is located on an upstream side of the backflow prevention device.

12. The blow-by gas refluxing device as in claim 8, wherein the second blow-by gas refluxing passage has an inlet connected to the first blow-by gas refluxing passage.

13. The blow-by gas refluxing device as in claim 8, wherein the intake air bypass passage has an opening and closing valve disposed therein.

14. The blow-by gas refluxing device as in claim 8, wherein the first blow-by gas refluxing passage has a blow-by gas flow rate adjusting valve disposed therein.

15. The blow-by gas refluxing device as in claim 8, further comprising a fresh air introduction passage connected to the at least one of the cylinder block and the cylinder head cover for introducing fresh air thereinto.

16. A blow-by gas refluxing device provided for an engine system including an engine, an intake air passage, and a supercharger and a throttle valve each disposed in the intake air passage, the throttle valve being disposed on a downstream side of the supercharger in the intake air passage, the blow-by gas refluxing device comprising:

a blow-by gas refluxing passage configured to allow blow-by gas produced in the engine to flow into the intake air passage and to be refluxed into the engine;

an intake air bypass passage connecting between an upstream side of the supercharger and a downstream side of the supercharger in the intake air passage;

wherein the blow-by gas refluxing passage comprises a first blow-by gas refluxing passage and a second blow-by gas refluxing passage;

wherein the first blow-by gas refluxing passage has an inlet and an outlet, the inlet being connected to at least one of a cylinder block and a cylinder head cover of the engine and the outlet being connected to the intake air bypass passage, and wherein the second blow-by gas refluxing passage has an outlet connected to the intake air passage on the downstream side of the throttle valve;

a jet pump capable of producing a negative pressure in the intake air bypass passage;

wherein the outlet of the first blow-by gas refluxing passage is connected to the intake air bypass passage via the jet pump; and a blow-by gas flow rate control device configured to control a flow rate of the blow-by gas refluxed through the first blow-by gas refluxing passage during an operation of the supercharger.

17. The blow-by gas refluxing device as in claim 16, wherein the blow-by gas flow rate control device is a blow-by gas flow rate adjusting valve disposed in the first blow-by gas refluxing passage.

18. The blow-by gas refluxing device as in claim 16, wherein the blow-by gas flow rate control device is an opening and closing device disposed in the intake air bypass passage.

19. The blow-by gas refluxing device as in claim 16, further comprising a backflow prevention device configured to prevent the blow-by gas from flowing from the second blow-by gas refluxing passage into the at least one of the cylinder block and the cylinder head cover.

20. The blow-by gas refluxing device as in claim 16, further comprising a fresh air introduction passage connected to the at least one of the cylinder block and the cylinder head cover for introducing fresh air thereinto.

* * * * *